United States Patent [19]

Henry, II

[11] 4,004,403

[45] Jan. 25, 1977

[54] EQUINE TRAINING AID BALANCER

[76] Inventor: Woodrow Henry, II, Bobbin Hollow Farm & Tack Shop Bay Road, Amherst, Mass. 01002

[22] Filed: May 16, 1975

[21] Appl. No.: 578,100

[52] U.S. Cl. ..... 54/71; 119/29

[51] Int. Cl.[2] ..... B68B 1/00

[58] Field of Search ..... 54/71, 1, 25, 38, 63, 54/5, 23, 16; 119/29

[56] References Cited

FOREIGN PATENTS OR APPLICATIONS

| | | | |
|---|---|---|---|
| 135,382 | 3/1880 | France | 54/71 |
| 9,691 | 10/1853 | France | 54/71 |
| 671,400 | 9/1929 | France | 54/71 |

*Primary Examiner*—Louis G. Mancene
*Assistant Examiner*—Peter K. Skiff
*Attorney, Agent, or Firm*—J. Gibson Semmes

[57] ABSTRACT

A training aid which is especially adapted to the equine body for the purpose of developing, in training, suppleness, flexion, balance and impulsion. The essential details comprise a combination upright check rein stanchion and yoke, which is disposed rearwardly adjacent the shoulders and withers of the equine and includes flexible crupper extension, stabilizing and connecting the stanchion to the equine quarters. The stanchion and yoke are adapted to secure plural check reins at one end, said check reins respectively being adapted to engage the single bit portion and the curb portion of a double or full bridle. The anchors of the stanchion are vertically adjustable for the snaffle check rein and associated normal bridle reins and the anchors of the yoke extension provide for adjustable disposition of the curb check rein, relative to the shoulders and withers of the equine. The invention is especially adapted to longeing or driving of the equine.

1 Claim, 3 Drawing Figures

FIG. 1
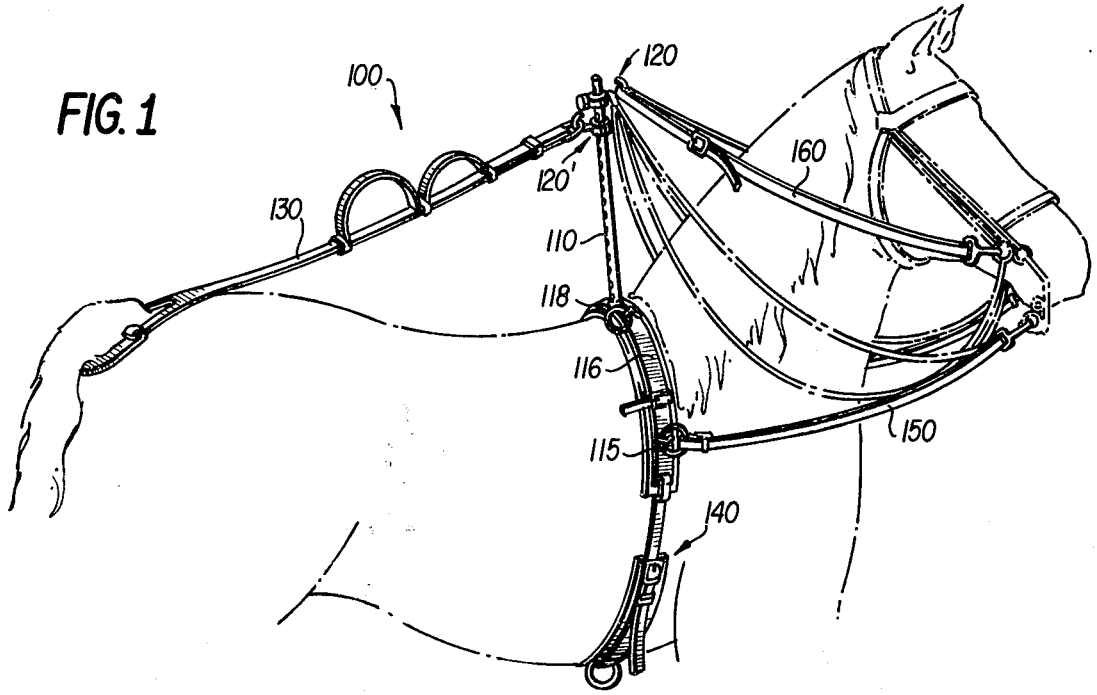
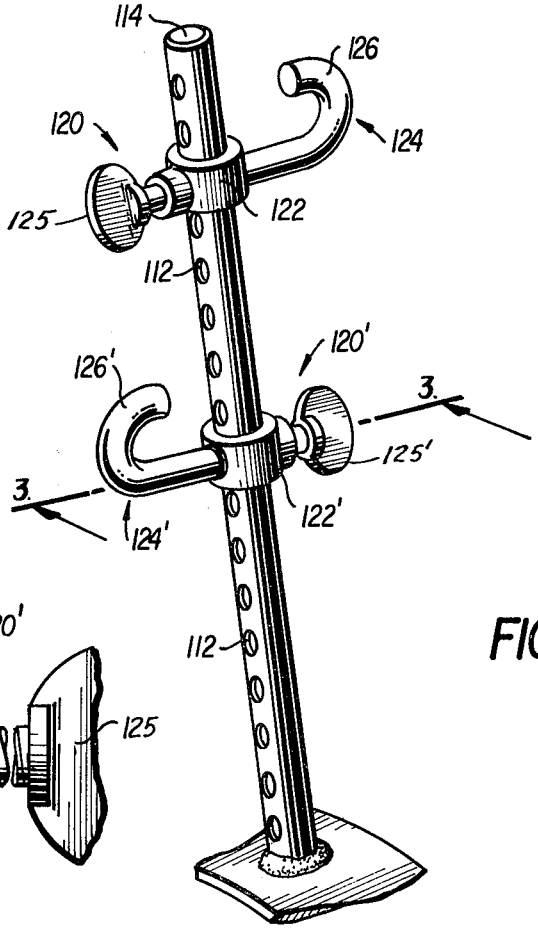
FIG. 2
FIG. 3
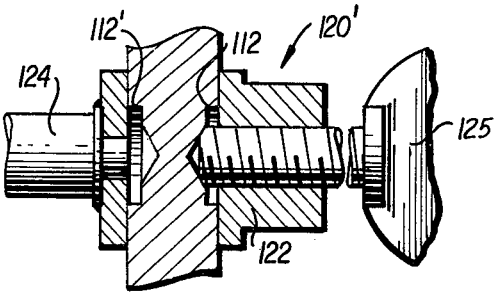

EQUINE TRAINING AID BALANCER

DESCRIPTION OF THE PRIOR ART

Whereas numerous devices have been devised for the driving, and indeed, for the training of the equine, canine and related species of animal, none of the prior art is adapted to establish in mobile training, an acceptance of the head gear, in this case, the bridle and bit, whereupon to establish proper head carriage, what is known as flexion, balance and impulsion. The present invention differs from the art as follows. The best of the known art comprises Chalfont U.S. Pat. No. 516,365 which is established to give a steadying rather than a balancing effect to the equine. The Lattimer U.S. Pat. No. 725,852 and the Christy U.S. Pat. No. 640,157 show, respectively, the uses of bridle checks and shaft tugs having crupper arrangements, which even if combined with a device of the type illustrated in Chalfont could not achieve the desired results of the present invention, which simulate the best of a mounted rider's expertise in training, while at the same time relieving the young horse from the necessity of carrying weight, and permitting training from the ground, as in longeing.

BRIEF DESCRIPTION OF THE DRAWING

FIG. 1 of the drawings is a view in perspective of invention showing the "off" side of the equine, and full bridle, the opposite or "near" side having the duplicate elements as are depicted in this FIG.;

FIG. 2 is a view in enlarged perspective of a portion of the invention, comprising the stanchion and yoke;

FIG. 3 is a vertical sectional view of a portion of the stanchion and one anchor thereof taken along the line 3—3 of FIG. 2.

DESCRIPTION OF THE PREFERRED EMBODIMENTS

With reference to FIG. 1, it will be noted that the training harness is broadly designated as 100, and comprises in combination with a conventional full or double bridle, the associated elements necessary to achieve the desired functions of teaching the equine to sustain its balance in movements at all of the various gaits to which he may be naturally and artificially guided. The essential elements comprise the vertical or upright stanchion 110 including the vertically adjustable anchors 120 and 120'; its associated yoke 116 having upper and lower anchor rings 118. The combination stanchion and yoke is secured essentially rearwardly of the withers and shoulders of the horse as by the surcingle 140 and the stanchion itself, in combination with the snaffle check rein 160, is retained in upright disposition by means of the flexible crupper extension 130 which connects the stanchion to the equine quarters, as illustrated. In conjunction with the respective stanchion and yoke, there are connected the respective snaffle and curb check reins 160 and 150 as will be more thoroughly described hereinafter. These check reins act in concert with the full bridle, independently of the conventional snaffle and curb reins which are shown in phantom as generally inactive. In essence, the upright stanchion 110, having fore and hind anchors 120–120' is retained in position by the flexible crupper extension 130, both stanchion and yoke having selectively adjustable connection with the full bridle by means of the check reins 150 and 160. The adjustment of the check reins is essential to the beginning and advanced training of the equine. Its acceptance of the bit and head carriage are indeed changeable determinate upon direction of movement, and state of training. For example to effect too soon, too short an adjustment will put the equine "behind" the bit and may even result in a lack of impulsion and regression in training.

With reference to the FIG. 2 illustration of the stanchion and associated fore and hind anchors 120–120' that the stanchion shown include plural bores 112–112' on the fore and hind portions thereof, said stanchion having a vertical end 114 and being fixed at its opposite end to the yoke 116. The anchors 120–120' include slideable collars 122–122' each being adapted to retain the anchors 126–126' in position along the stanchion by means of set screws 125–125', they having threaded engagement with the threaded bores 112.

The various functions of the combination anchors and check reins and flexible crupper strap extension are as follows. The strap which extends from the crupper at the quarters, to the vertical extension created by the stanchion and securing in anchor 126 at the hind portion thereof, is adapted to be situated substantially adjacent the withers of the horse, thereby in combination with the snaffle check rein 160, attaining a supple and balanced equine. Secondarily, this extension 130 prevents the stanchion from slipping forward, as will be obvious. The shoulder piece or yoke 116, in combination with the surcingle and associated padding secures the stanchion in its position, adjacent the withers and secondarily serves as an anchor for the respective means of securing the curb check rein 150 in position. It will be obvious that the curb check rein 150 may be secured at either of the yoke rings 115 or 118', respectively, on both sides, the near side of the device not being shown. The combination shown simulates to a degree the use of draw reins. By this particular arrangement of the curb check rein 150, relative to the curb bit of the full bridle and the shoulder piece or yoke 116, one may achieve through driving the animal as in longeing, an acceptance of the bit when the equine head is properly flexed at the poll. This also teaches flexion of the head and results in engagement of the quarters and thus desired impulsion in movement. By adjustment of the respective anchors for the snaffle and curb check reins, respectively, various gradations of high and low head carriage and acceptance of the bit may be achieved as well as the desired flexion and impulsion, thereby effecting a facile transition from the longeing training to actual rider control.

I claim:

1. An equine training aid adapted to the equine body and having coactive relationship to a conventional double bridle, said bridle having snaffle and curb bits and reins therefor, comprising in combination therewith:

A. a check rein stanchion and yoke, disposable rearwardly adjacent the shoulders of the equine, said stanchion having plural bores disposed in vertical alignment on opposite fore and aft positions of the stanchion and said stanchion bearing opposed fore and hind check anchors, said anchors engaging the stanchion by means of set screws in vertically adjustable relation thereto and means for removably securing the stanchion and yoke to said equine;

B. a snaffle bit check rein controllably connecting the snaffle bit of the bridle to the fore check anchor of the stanchion;

C. at least two yoke rings at least one thereof upon the yoke on either side of the equine, to join the curb bit check reins from an anchor end thereof to the curb bit;

D. a flexible crupper extension for connection of the stanchion to the equine quarters; the hind check anchor and locking pin thereof retains the crupper extension to stabilize the stanchion.

* * * * *